United States Patent [19]

Dean et al.

[11] Patent Number: 4,848,475

[45] Date of Patent: Jul. 18, 1989

[54] SEA BED PROCESS COMPLEX

[75] Inventors: Alan J. Dean, Skene; Hans P. Hopper, Abderdeen, both of Scotland

[73] Assignee: The British Petroleum Company p.l.c., London, England

[21] Appl. No.: 173,330

[22] Filed: Mar. 24, 1988

[30] Foreign Application Priority Data

Mar. 26, 1987 [GB] United Kingdom ..... 8707307

[51] Int. Cl.[4] ..... E21B 43/36; E21B 33/035

[52] U.S. Cl. ..... 166/357; 166/335; 166/339; 166/351; 166/368

[58] Field of Search ..... 166/335, 338, 339, 351, 166/357, 366, 368

[56] References Cited

U.S. PATENT DOCUMENTS

| | | | |
|---|---|---|---|
| 3,754,380 | 8/1973 | McMinn et al. | 166/357 X |
| 4,378,848 | 4/1983 | Milberger | 166/366 X |
| 4,438,817 | 3/1984 | Pokladnik et al. | 166/357 X |
| 4,452,312 | 6/1984 | Roblin | 166/339 |
| 4,732,215 | 3/1988 | Hopper | 166/366 |

FOREIGN PATENT DOCUMENTS

| | | | |
|---|---|---|---|
| 1581995 | 12/1980 | United Kingdom | 166/357 |
| 2194980 | 3/1988 | United Kingdom . | |
| 2195412 | 4/1988 | United Kingdom . | |
| 2196051 | 4/1988 | United Kingdom . | |
| 2196081 | 4/1988 | United Kingdom . | |
| 2197675 | 5/1988 | United Kingdom . | |
| 2202879 | 10/1988 | United Kingdom . | |

*Primary Examiner*—Bruce M. Kisliuk

*Attorney, Agent, or Firm*—D. P. Yusko; D. J. Untener; L. W. Evans

[57] ABSTRACT

A sea bed oil producing and processing complex has a template with three bays housing pairs of modules, viz, well, gas and oil production modules. The complex includes a separator for separating oil and gas and a pump for the produced oil, and bars having pipework to carry fluids between the pairs of modules and to despatch separated gas and oil. Saddles may carry fluids across between individual modules of a pair and the complex may have facilities for artificial lift, water injection, chemical fluid injection and for test fluids. Multiples of the three bays and pairs of modules may be within a single template and a number of modules may surround a central piping template. The complex can be services and maintained in a diverless mode using a monohull vessel and an ROV.

9 Claims, 11 Drawing Sheets

SEA BED PROCESS COMPLEX

This invention relates to a sea bed process complex for producing crude oil and for separating it from associated gas.

In the present state of technology for producing oil from underwater wells, oil production well heads can and have been positioned on the sea bed. However, the produced oil from these underwater well heads has to be brought to the water surface to be processed on fixed or floating platforms. Such processing includes separation of associated gas from the oil and separate despatch of the oil and gas. Other possible processing requirements include water injection to maintain well productivity (so-called "secondary recovery"), injection of artificial lift fluid to encourage oil production and chemical fluid injection into the oil.

Fixed or floating platforms carrying this processing equipment are necessarily large, heavy and expensive. As the water depths from which oil is produced become greater, so the size of fixed platforms increases and there is a practical limit to the water depth in which a fixed platform can be placed. Theoretically, floating platforms are not so limited and could process oil produced from any water depth. However, they have to be kept on station by mooring lines, tethers and/or thrusters and as water depths increase, so does the severity of sea and weather condiitons that the platforms have to be designed to withstand. In practice, therefore, the cost and size of floating platforms also tend to increase as water depth increases.

The present invention is concerned with a sea bed complex for producing and processing crude oil without the need for any permanent above-surface facilities. If required it could be installed and operated without diver intervention and could be routinely maintained and serviced by a monohull vessel using a remotely operated vehicle (ROV).

According to the present invention, a sea bed oil producing and processing complex comprises:

(i) three bays housing pairs of modules, which are
  (a) a well bay and modules
  (b) a gas bay and modules, and
  (c) an oil production bay and modules
(ii) a separator and pump for separating oil and gas and pumping separated oil,
(iii) a piping bar connecting the well bay, gas bay and production bays at right angles to the pairs of modules, and
(iv) piping bars parallel to the gas and production pairs of modules for the despatch of separated oil and gas.

The invention is further described and illustrated with reference to the accompanying drawings in which FIG. 1 is a three dimensional partly exploded sketch of the complex showing its component parts and their positions using modulator schematics.

FIG. 2 is a fully exploded sketch of FIG. 1 showing also the crude oil and gas and oil production flows, FIG. 3 is a flow diagram of the complex, FIG. 4 is a view of a pair of well modules, FIG. 5 is a view of a pair of gas modules, FIG. 6 is a view of a pair of production modules, FIG. 7 is a view of a piping cross bar, FIG. 8A is a plan view of a 15 well sea bed process complex based on a series of units as described in FIGS. 1 to 7, FIG. 8B is a three-dimensional view of the same complex and FIG. 8C a section through it.

Figure 1:
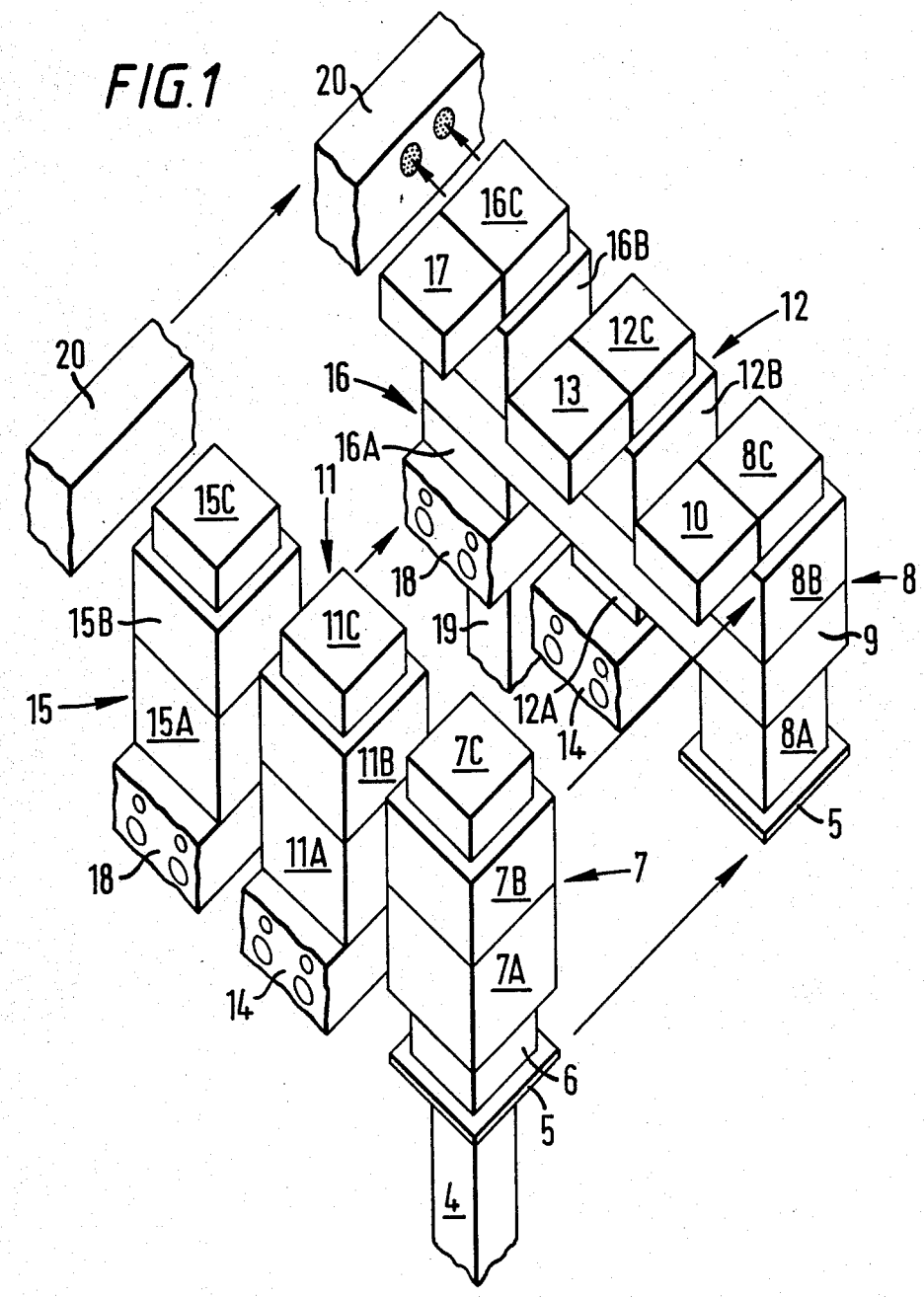

In FIG. 1 an underwater well 4 extends down into the sea bed, hung from a sub sea template whose datum is indicated diagrammatically at 5. Above the well is a well head 6 on which is a well module 7. This is formed of a lower well tree block 7A, upper tree block 7B and a protective cap 7C. This cap can be referred to as, alternatively, a high pressure cap, a corrosion cap, or a debris cap. Adjacent to the well tree (but separated from it in the drawing because it is a partly-exploded view) is a well choke module 8. This is supported on a dummy well head 8A, which is located on a sub sea template 5. Above the dummy well head is choke block 8B and control block 8C, which also houses a choke operator. Between dummy well head A and choke block 8B is a piping cross bar 9 extending at right angles to the plane of the well module 7 and well choke module 8. Well tree module 7 and well choke module 8 are linked by a saddle 10 which carries pipe work across from well tree module 7 to well choke module 8.

Parallel to the pair of well modules are two further pairs of modules. Adjacent to the well tree module is a gas production module 11, also formed of a lower gas manifold block 11A, an upper gas flow control block 11B and a choke control cap 11C. Adjacent to the well choke module 8 is a gas module 12, formed, like the well choke block, of a lower dummy wellhead 12A, choke block 12B and a control block 12C. Gas production module 11 controls the flow of gas. Module 12 with its choke and controls is therefore, available as an artificial lift fluid introduction and control module, if required. These pairs of modules are also linked by a saddle 13. The piping cross bar 9 rests on the dummy well head 12A, below choke block 12B. Below gas modules 11 and 12 is a gas piping bar 14 running parallel to the plane of the module pair and hence at right angles to the cross bar. The gas piping bar 14 carries four pipes, the purpose of which will be described hereafter with reference to FIG. 3.

There is a further pair of oil production modules, similar to the gas bay modules. There is an oil production module 15 formed of production manifold block 15A, upper choke block 15B and control cap 15C, and a pump module 16 formed of separator head 16A, upper pump head block 16B and pump head cap 16C. Piping cross bar 9 is connected to the separator head 16A upon which is the pump head block 16B. Saddle 17 links the oil production modules and below the modules and parallel to their plane is an oil production piping bar 18, with four pipes, described hereafter with reference to FIG. 3. Below pump module 16, drilled into the sea bed, is a vertical annular oil and gas separator 19. This is shown diagramatically in FIG. 3 and is more particularly described in U.S. application Ser. No. 173332.

Essentially the separator is a false well. It is drilled into the sea bed and casing is set to give a central passage and two annular passages around it. A hydraulic or electrical pump is placed near the bottom of the separator. The separator is of such a size in relation to the crude oil flow from the well that the crude oil has a residence time in the separator sufficient to separate into oil and gas phases. The crude oil is fed into one of the annuli of the separator and it separates at the base of it.

The gas phase flows up the other annulus and the oil phase is pumped up the central passage. The way the crude oil is directed into the separator and the way the gas and oil phases are despatched from the complex will be described hereafter with reference to FIGS. 2 and 3.

The final component of the complex is a control tray 20 running along the side of the pair of oil production modules. All the necessary hydraulic and electrical power and signals to operate and control the complex is fed in through this control tray 20.

Figure 2:
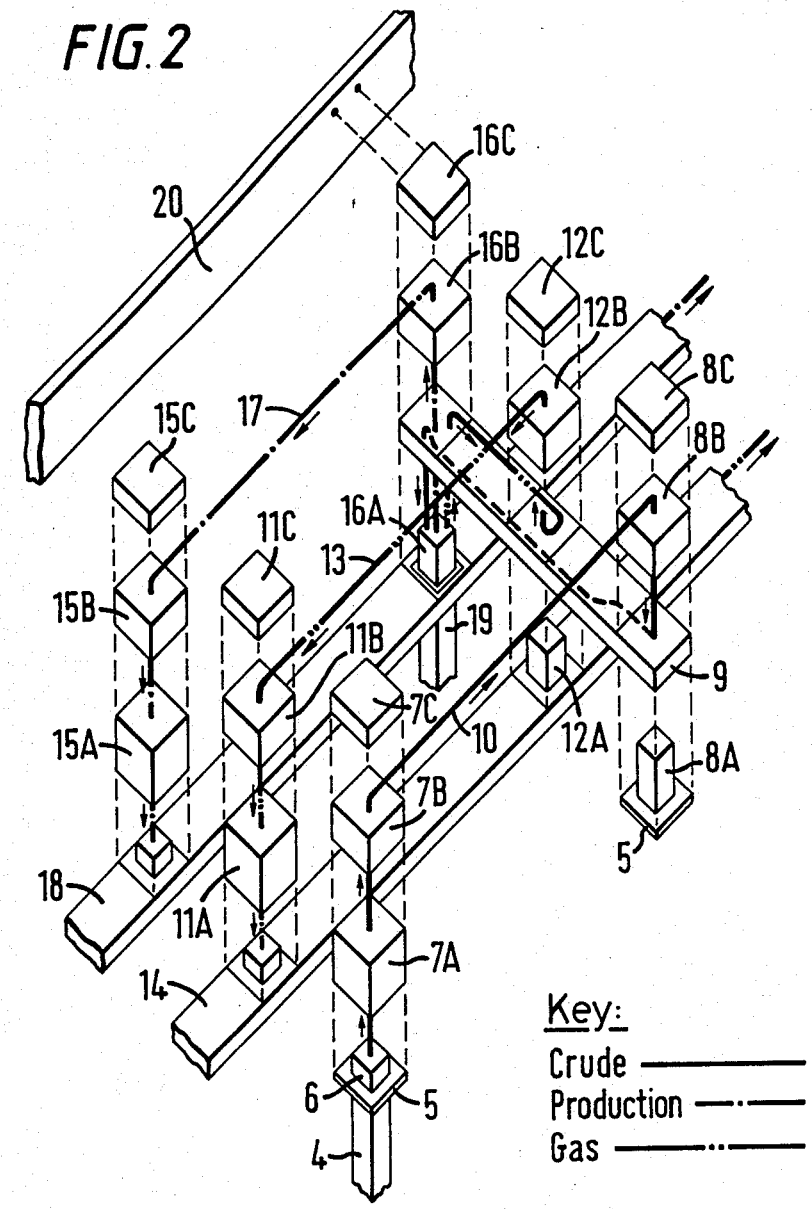

FIG. 2, which is a fully exploded view of FIG. 1, shows the fluid flows, with crude oil, oil production and gas production being indicated according to the legend. Crude oil from well 4 flows up through well module 7 across the saddle and down into well choke block 8B. It is then fed into and along cross bar 9 and hence down through separator head 16A into separator 19. Oil production from the separator 19 is pumped up the central passage of the separator and up through block 16A, and cross bar 9 into block 16B, then across the saddle 17 to production module 15 and down through it to the oil production piping bar 18. It can then be despatched from the complex through any convenient pipe line to any convenient recovery system.

Gas coming up one of the annular passages of the separator flows into separator head 16A into and along cross bar 9, up into block 12B, across the saddle 13 into module 11 and hence into gas piping bar 14 for despatch from the complex.

Figure 3:
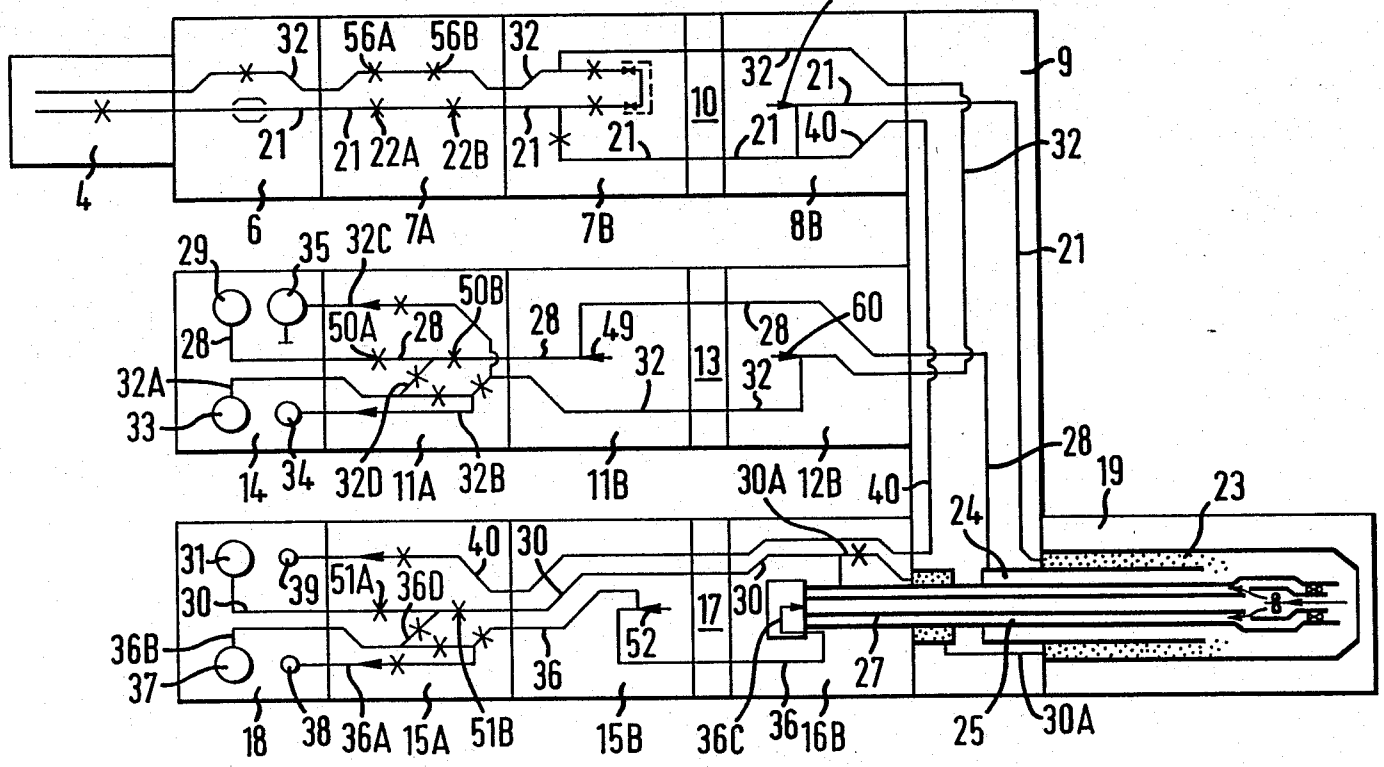

FIG. 3 shows the flows more schematically and also shows what other services can be provided utilising the components of the complex.

In FIG. 3, not all the modules and blocks are necessarily shown, but all those relevant to the flow and flow control are. The legend gives information on the nature and purpose of the lines.

Crude oil from well 4 flows through line 21 through the tree module passing through two conventional master valves 22A and B in lower tree block 7A. It flows through upper tree block 7B to saddle 10 and well choke block 8B, which houses choke 48 and along the cross bar 9 to an annulus of separator 19. The inner annulus of the separator is indicated as 24, the outer annulus as 23 and the central passage as 25. At the bottom of separator 19 is pump 26 with a pipe 27 in the central passage to supply hydraulic drive fluid to a hydraulic pump (or to act as a conduit for electrical cables to an electrical pump). Depending on the choice of vertical separator the crude oil can be directed to either the inner or the outer annulus the separated gas then flowing up the other. In FIG. 3 the crude oil flow has been taken as directed to the outer annulus 23 with the gas coming up inner annulus 24.

Gas separated in the separator flows through inner annulus 24 to line 28 in the cross bar 9. Line 28 then carries the gas straight through the block 12B (which is used solely for artificial lift flow control if required) across saddle 13 into gas flow control block 11B having flow control choke 49 and thence into gas manifold block 11A where there are shut off master 50A and B. It then passes into despatch pipe 29 in gas piping bar 14.

Separated production oil (with any produced water) is pumped up central passage 25 of the separator. Line 30 carries it through pump head module 16B across saddle 17, through block 15B to the production manifold block 15A where there are master valves 51A and B. It is despatched through oil despatch pipe 31 in oil piping bar 18.

As is conventional practice, well 4 has an annulus line 32 parallel with line 21 which can, if required, be used to supply artificial lift fluid to the well. It goes up through the well tree modules, along the cross bar and into the gas modules passing through flow control valve 60 in block 12B. In gas block 11A it splits into three with shut off valves. Branch 32A leads to a second main pipe 33 in gas piping bar 14. Pipe 33 is marked T to indicate that its primary purpose is for testing. Branch 32B leads to an artificial lift fluid pipe 34 in the gas piping bar 14 and branch 32C leads to a water injection pipe 35 in the gas piping bar 14. If desired, therefore, line 32 can be used to supply to the well artificial lift fluid, injection or flushing water, or as a kill circulating line. A cross pipe 32D with valve connects branch 32A to the gas line 28. The cross pipe 32D with its valve connects gas line 28 to test pipe 33 so that the gas line can be individually tested and the gas flow checked and monitored. If required pipe 33 could be used to duplicate the main gas despatch pipe 29.

In the oil production modules, besides the oil production line 30, there is also a line 36 from the central passage 25 of the separator. This splits in production manifold block 15A, into two branches, branch 36A going to a pump drive fluid pipe 38 in the oil piping bar 18 and branch 36B going to test pipe 37. If the separator has a hydraulic pump, line 36 would be used to provide pump drive fluid from pipe 38 through branch 36A, there being a pump head cap flow path 36C where pipe 38 reaches the separator so that pump drive fluid is fed into pump drive pipe 27. Valve 52 in block 15B can be used to control the pump drive fluid flow. As in the gas manifold 11A, a cross pipe 36D with valve connects oil production line 30 with line 36B to test pipe 37 in oil piping bar 18. This allows the oil production line to be individually tested, a necessary requirement if flow from several wells is commingled. If required pipe 37 could be used to duplicate the main oil despatch pipe 31 in oil piping bar 18.

The pump drive fluid supplied through pipe 38 can be dead crude. Even if the pump is an electrical pump so that a supply of pump drive fluid is not required, dead crude supplied through pipe 38 could be used to purge line 36B and test pipe 37 or through line 36D the main oil production line 30 and despatch pipe 31.

Finally, oil production piping bar 18 has a chemical injection fluid pipe 39. Line 40 runs from pipe 39 through the oil production modules, along the cross bar and into the crude oil line 21 from the well. Chemical fluid can thus, if desired, be injected into the crude oil between well 4 and separator 19.

It will thus be seen that the sea bed complex with its components and modules can provide all the processing and servicing that would normally be on a fixed or floating platform. Once in place on the sea bed, the complex gives an operator all the normal options for maintaining and controlling an underwater well whatever its status and production history. This control can be exercised without any permanent water-surface facility. Umbilicals feeding into control tray 20 can provide all the required hydraulic and electrical power for operating the valves, etc., of the complex and all the electrical wires for activation of the control systems of the complex.

Other significant features of the complex are:

The hydraulic/electrical systems for each of the pairs of modules are separate and on top of each of the modules. Each pair of modules has its own hydraulic power supply and controls actuated by electrical signals.

Production oil can, if desired, be dumped back into separator 19. This can be achieved through loop 30A having a valve in it. This loop can take production oil from central passage 25 of the separator and return it to outer annulus 23. This ensures that if oil flow is interrupted, oil continues to circulate in the separator so that the pump does not run dry.

The four pipes in each of the gas and oil piping bars are at the outsides of the bars so that they can pass outside any well heads or other components on the sea bed. Specifically, the pipes of oil production bar 18 pass on either side of the separator head 16A and the selector head (59 of FIG. 6) used to support oil production module 15A. Lines 31 and 37 connect the pipes to module 15A. Similarly, the pipes of gas production bar 14 pass on either side of the sea bed supports provided for gas production module 11 and gas module 12, i.e. the selector head (59 of FIG. 5) which supports module 11A and the dummy gas head 12A of gas module 12. Lines 29 and 33 connect the pipes to gas manifold module 11A.

Since the complex is modular, each component can be placed individually on the sea bed to build the complex and each component can be removed for servicing and replacement. The landing and removal of the components can be effected from a vessel, e.g. a mono hull vessel, with the assistance of a remotely operated vehicle (ROV) if required.

The specification of published U.S. Pat. No. 4,732,215 describes a sub sea oil production system having a three-dimensional template into which various tree blocks and manifold blocks can be placed, the three-dimensional framework of the template serving to guide the blocks into position. It will readily be seen how the specific description of U.S. Pat. No. 4,732,215 can be adapted to provide not only well tree and manifold modules but also gas and oil production modules. The drilling of the false well and the running of casing strings to form the separator can be effected using the template in the same way as the template can be used to drill production wells.

All controls and valves can have facilities for manual emergency operation by a ROV, all manual over-rides extending vertically up to the top of the modules.

All modules, blocks and components can have releasable couplings to allow for fluid or electrical current flows between them. Again previously filed UK Patent Applications have described various releasable couplings for passing hydraulic and electrical power into underwater oil production complexes, and between blocks or components of a complex. The following UK Patent Applications are relevant in this context.

UK Patent Application No. 2180107A Underwater Electrically Conductive Coupling.

UK Patent Application No. 2194980A Control Systems for Subsea Oil Production.

UK Patent Application No. 2195412A Fluid Coupling.

UK Patent Application No. 2196081A Underwater Junction Plate and UK Patent Application No. 2196051A Locking Mechanism.

UK Patent Application No. 8712056 Insert Choke

UK Patent Application No. 8726545 Stimulating Oil Production.

The saddles used to link the modules of each pair can be of the type described in UK Patent Application No. 8707303 entitled Underwater Saddle.

Figure 4:
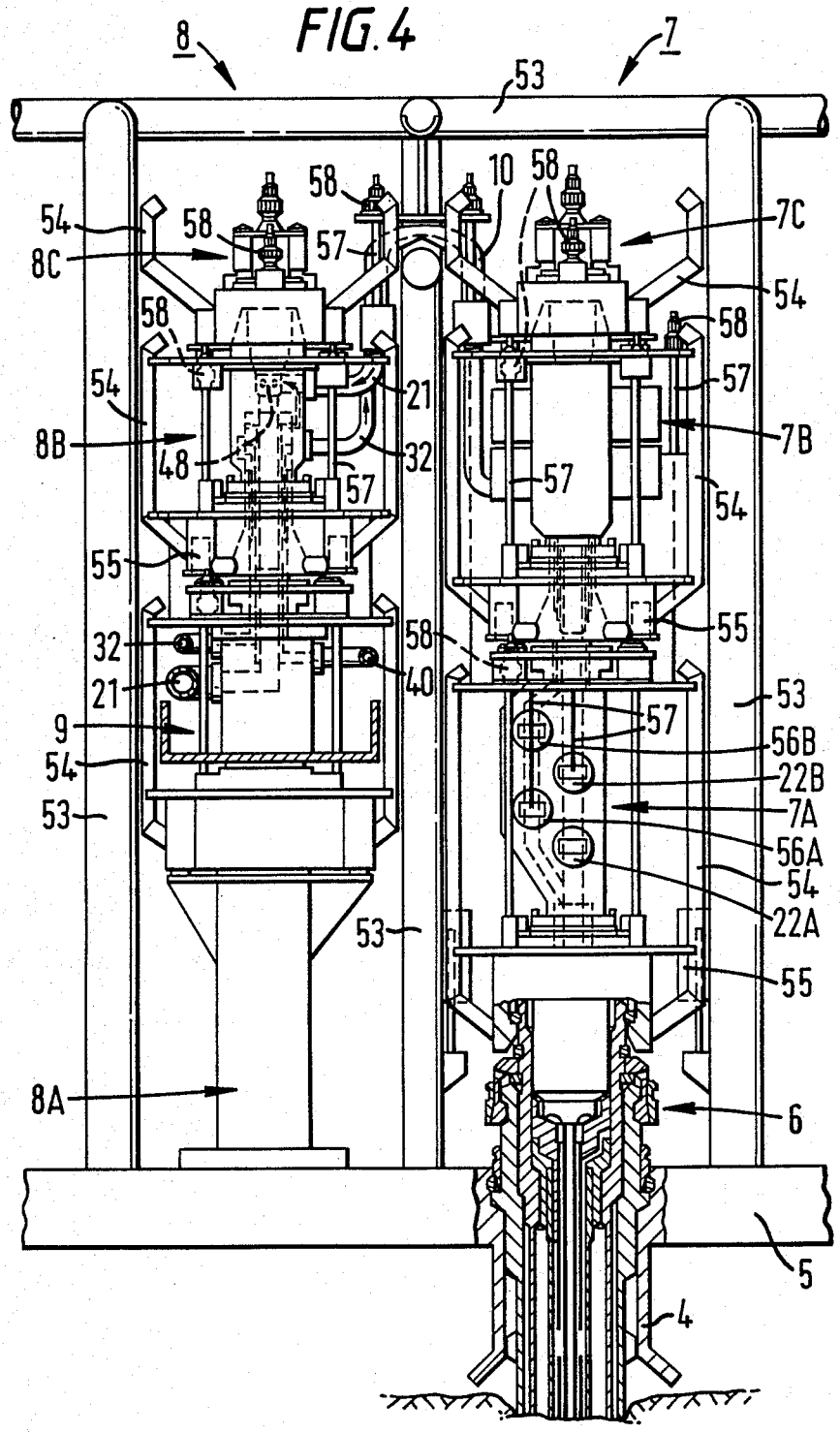
Figure 5:
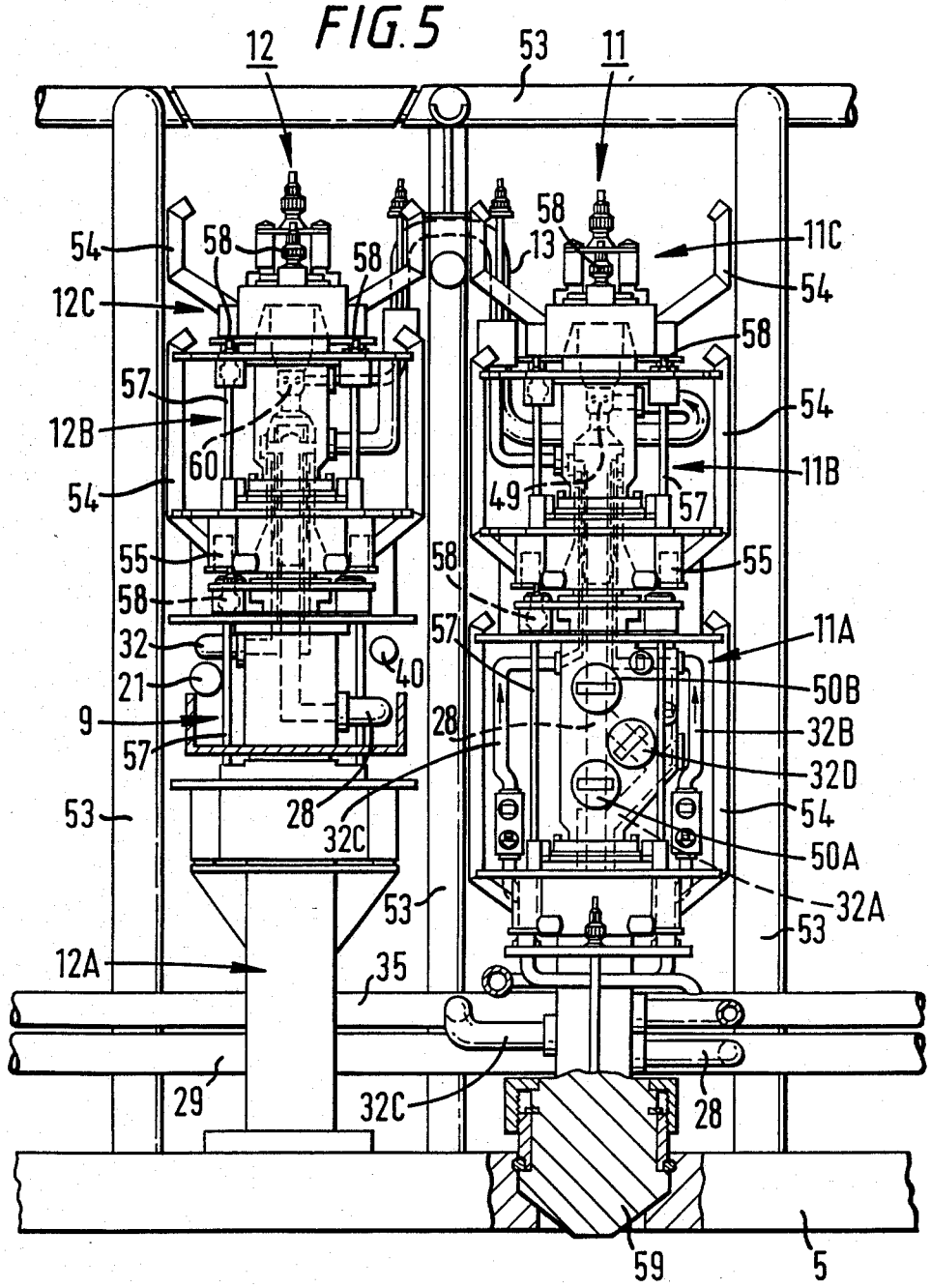
Figure 6:
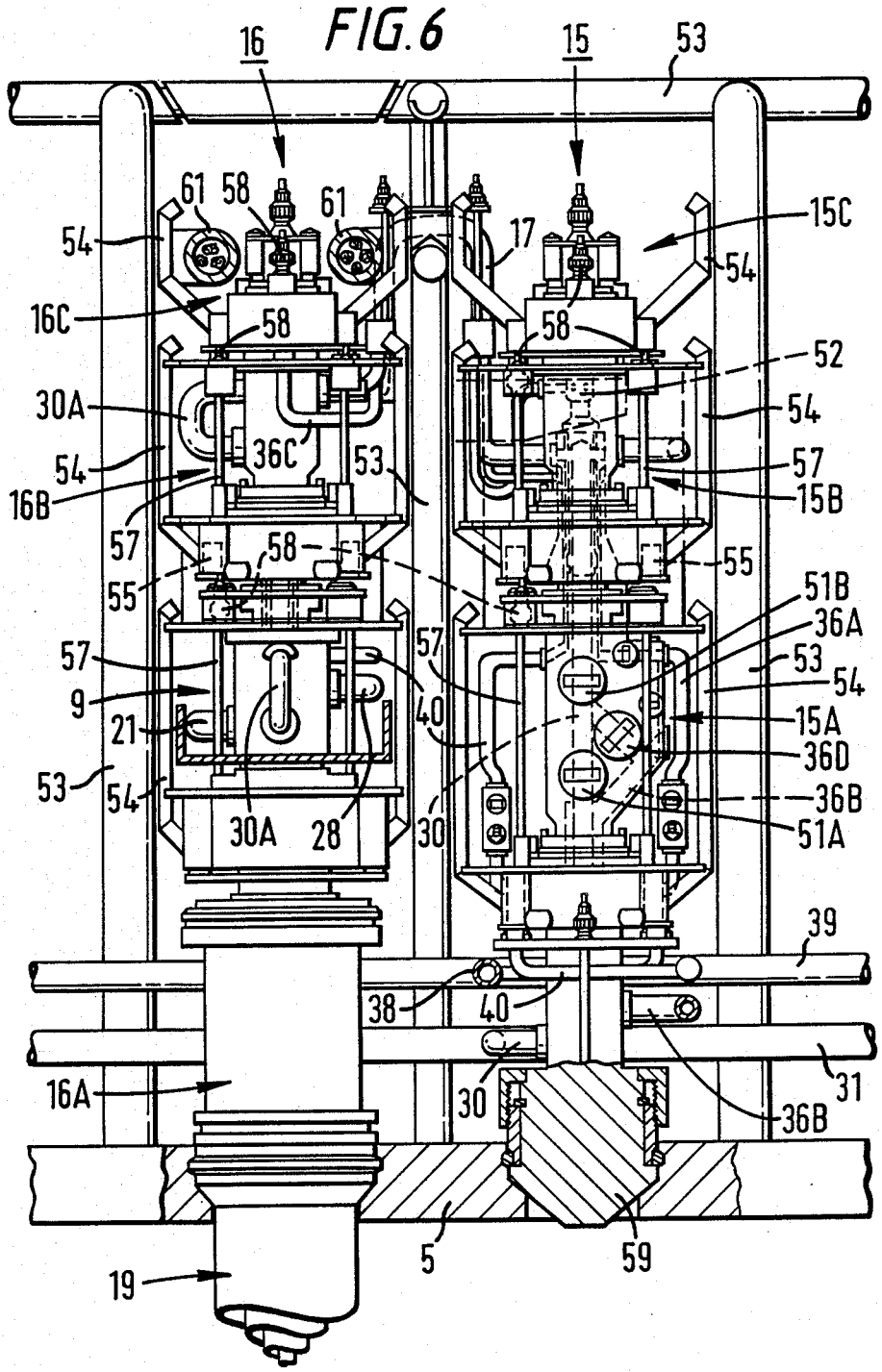
Figure 7:
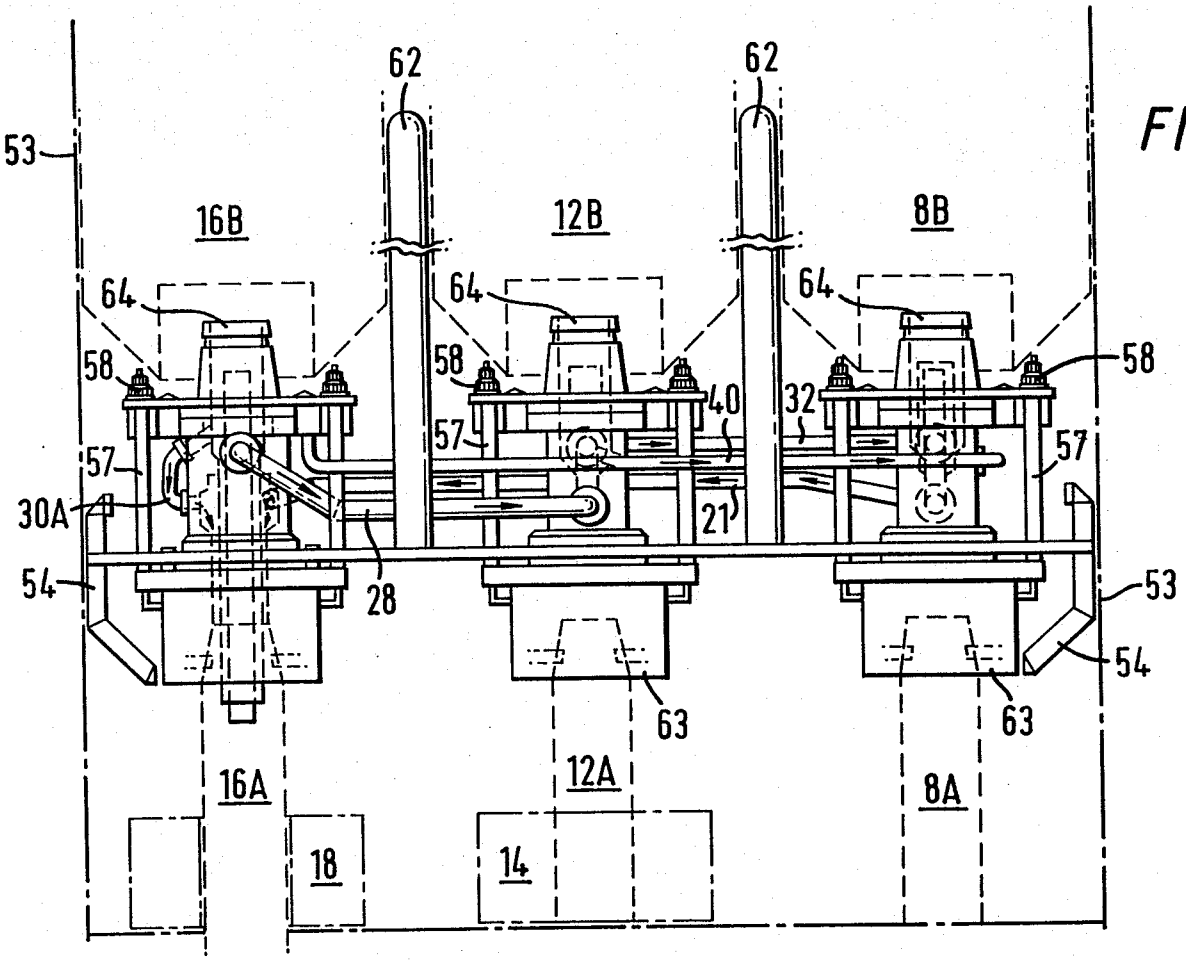

FIGS. 4, 5, and 6 which are views, respectively, of a pair of well modules, a pair of gas modules and a pair of oil production modules, and FIG. 7 which is a view of a piping cross bar, show more detail of the complex, including some of the features mentioned above.

In FIG. 4, well module 7 is on the right and well choke module 8 on the left. Well 4 with its casings hangs from well head 6 supported in template 5. Lower well tree 7A, upper tree block 7B and cap 7C are above the well head in a three-dimensional template structure 53 as described in UK Patent Application No. 2174442A. To fit within the template structure blocks 7A and 7B and cap 7C have a framework 54 of chamfered corner posts. Soft landing jacks 55 control the landing of the blocks in the framework. Lower tree has valves 22A and 22B in the crude oil production line and valves 56A and 56B in the annulus line (which as explained with reference to FIG. 3 can be used for artificial lift fluid or for monitoring the annulus). Rods 57 and spigots 58 are shown diagrammatically as mechanical overrides for the valves and the connectors, their extensions and dovetails not being shown.

Choke module 8 has dummy well head 8A, piping cross bar 9, choke block 8B and control block 8C, each again having a chamfered corner post framework 54 and soft landing jacks 55. Choke block 8B has choke 48 within it controlled from block 8C, manually if required. Override rods 57 and spigots 58 are also provided.

Saddle 10 connects the modules carrying across line 21 for oil and line 32 for water or artificial lift fluid. These extend into piping cross bar 9, which also has chemical injection line 40 in it for supplying chemical fluid to crude oil line 21 upstream of the choke. Saddle 10 has its own override rods 57 and spigots 58.

The pair of gas modules, 11 and 12 are shown in FIG. 5 Module 11 sits on a selector head 59 in template 5 and is formed of gas manifold block 11A, gas flow control block 11B with choke 49 and choke control cap 11C. Valves 50A and 50B of gas line 28 are in block 11A with cross over valve 32D to test line 32A. Also shown are the artificial lift fluid line 32B and water injection line 32C. These lines lead to the pipes of gas production bar (14 of FIG. 1). Gas pipe 29 and injection water pipe 35 are shown behind the modules. Test pipe 33 and the artificial lift fluid pipe 34 (FIG. 3) being in front of the modules are not shown for purposes of clarity.

Saddle 13 carries gas line 28 and line 32 across to module 12. This is formed of dummy well head 12A, piping cross bar 9, artificial lift flow control block 12B and control block 12C. Gas line 28 passes through block 12B to the piping cross bar 9, line 32 passes through choke 60, which can be used, if required, to control the supply of artificial lift fluid. Shown in piping cross bar 9 are also crude oil line 21 and chemical fluid injection line 40.

The pair of gas modules have similar override rods 57, spigots 58, to the well modules of FIG. 4 and are positioned in the same way as the modules of FIG. 4 using frameworks of chamfered corner posts 54 within template framework 53 and soft landing jacks 55.

The same framework system 53, 54 and jacks 55 can also be seen in FIG. 6, which shows the pair of oil production modules 15 and 16. Override rods 57 and spigots 58 are also present.

Oil production module 15 has a selector head 59 on template 5, production manifold block 15A, choke block 15B and control block 15C. Oil production line 30 has valves 51A and 51B in block 15A and a cross over line and valve 36D connects line 30 with test fluid line 36B. Block 15A also shows chemical fluid injection line 40 and pump drive fluid line 36A. These various lines lead to the oil production bar (18 of FIG. 1) and its oil production pipe 31, chemical fluid injection pipe 39, pump drive fluid pipe 38 and production test line 37. Test fluid pipe 37 is not shown, but line 36B from it is. Choke block 15B has choke 52 to control the flow of pump drive fluid if a hydraulic pump is used for the separator. If an electric separator pump is used, neither choke 52 nor any of the pump drive fluid system is required. Saddle 17 carries lines 30, 36 and 40 over to pump module 16, having, from bottom to top, separator head 16A, piping cross bar 9, pump head block 16B and pump head cap 16C. The top of the separator 19 is also shown extending down below template 5 into the sea bed.

Piping cross bar 9 has, at this part of its length, crude oil line 21 leading crude oil to the separator, gas line 28 taking gas away from the separator, and chemical fluid injection line 40.

Pump head module 16B has pump drive fluid line 36C (if the pump is hydraulic) and line 30A which allows production oil to be recycled back into the crude oil line to the separator.

Pump head cap 16C has the controls for the pump and is also the point in the complex where all the required hydraulic and electrical power lines and control lines for the complex enter it from control tray 20 (FIGS. 1 and 2). Plugs 61 are shown for carrying the lines across with a number of bundles of lines within them.

FIG. 7 is a view of piping cross bar 9. The lines have the same numerals as in previous figures and the direction of the fluid flows is indicateed by arrows. The drawing shows also that the cross bar has its own chamfered corner post 54 for fitting within the template framework 53 (indicated in this drawing by dotted lines). It has its own framework section dividers 62 to guide and align the module blocks which are placed above it. The cross bar has dummy connector caps 63 so that it can be releasably latched onto dummy well head 8A, dummy gas head 12A and releasably locked onto separator head 16A. Gas production piping bar 14, and production poil piping bar 18 are also indicated by dotted lines. The cross bar also has connector hubs 64 which receive the connector caps of the blocks which are seated above it, viz well choke block 8B, choke block 12B of the gas module and pump head block 16B (which are all indicated by dotted lines). The connectors have override rods 57 and spigots 58 for mechanical unlocking in the event of failure of the normal hydraulic locking and unlocking system.

The above description has illustrated the features required for operating and controlling a single well. A number of such individual complexes can be combined to form a multi-well sea bed complex. One such multi-well complex is illustrated in FIGS. 8A, B, and C.

Figure 8A:
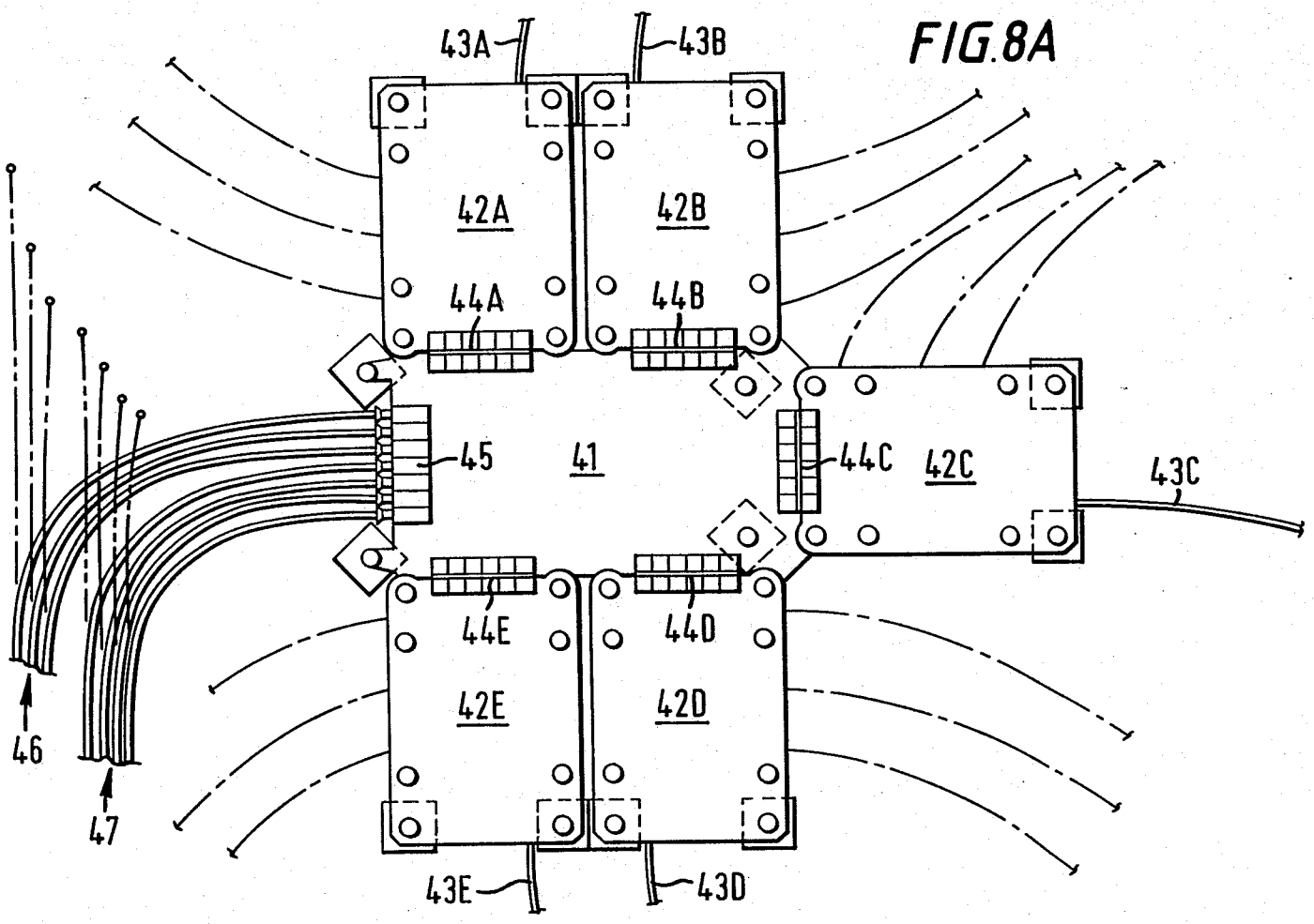
Figure 8B:
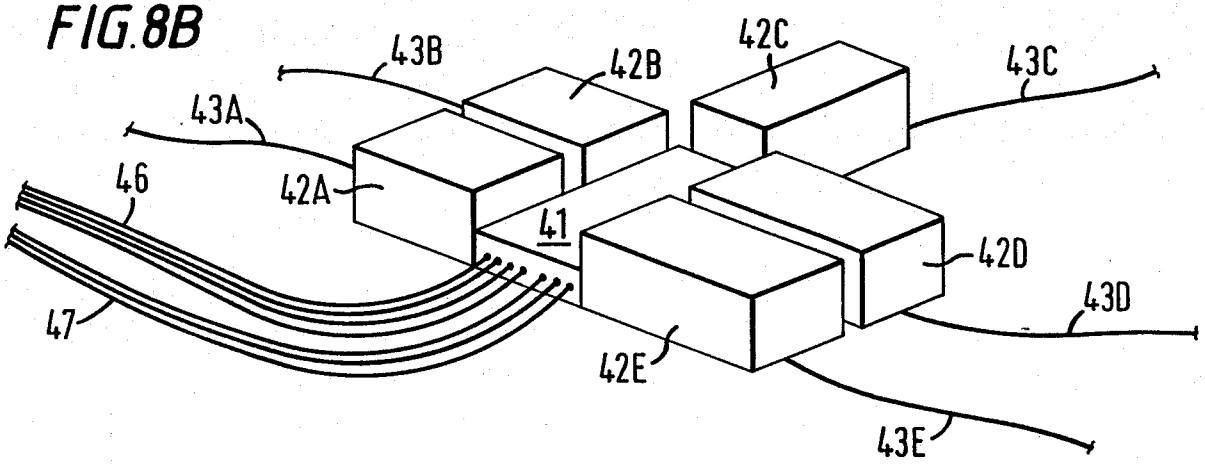
Figure 8C:
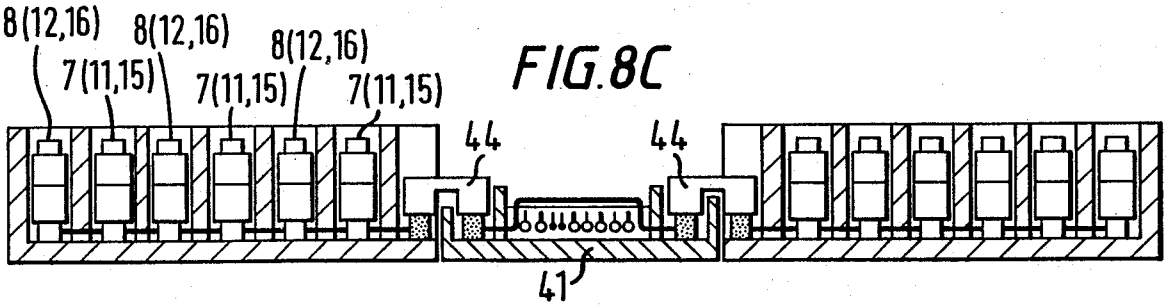

FIGS. 8A, B and C show a central piping template 41 piled onto the sea bed. Surrounding it are five three well process templates 42A,B,C,D, and E. Each three well process template is formed of three individual well units as described in FIGS. 1 to 7 but having a single control tray for the three units.

Figure 9:
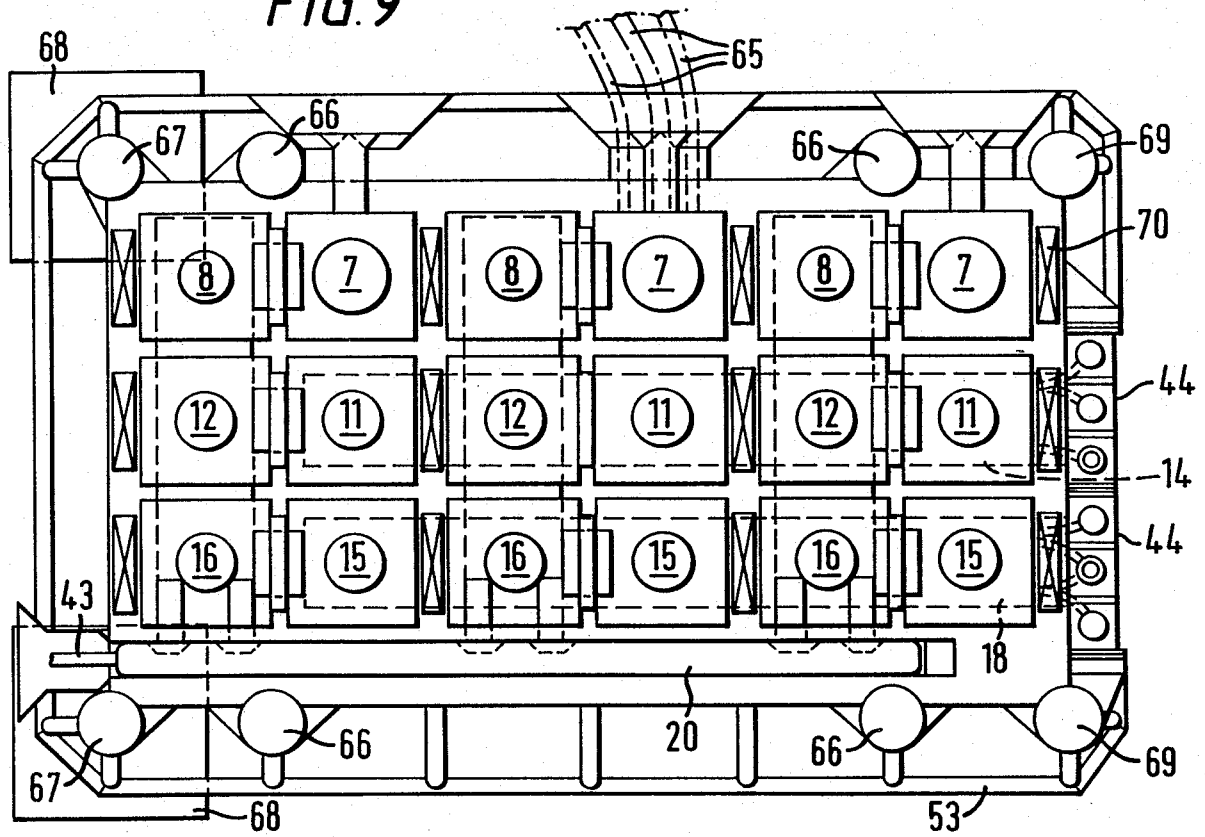
FIG. 9 is a plan of a three well template of the complex of FIG. 8.

FIG. 9 shows such a three well process template with the three pairs of modules placed side by side. The gas production bar 14 and the oil production bar 18 are extended to run through all three sets of modules, and all the modules are supplied from a single control tray 20.

Umbilical 43 leads all the required power and signal lines into the control tray. If the three well process template is required to receive and handle crude oil from satellite wells and to provide power and fluids for such satellite wells, then this can be done through lines 65.

FIG. 9 shows the template structure 53 for the complex fixed to the sea bed by piles 66 and with screw jacks 67 for levelling. The template may also have mud mats 68 to help to take the weight of it.

As will be seen from FIGS. 8A, B, and C, a number of the three well process templates can be placed around a central piping template 41. The right hand end of the template of FIG. 9 is the end adjacent to the piping template so it is not necessary to have screw jacks or mud mats at this end. Instead, there may be docking sleeves 69 that fit over the piping template docking piles. Hatches 70 for ROV deployable inspection units are shown between the sets of modules.

The pipes of the gas production bar 14 and the oil production bar 18 pass to the piping template 41 over jumper connectors 44. The connection for the gas production bar is split into three parts carrying, respectively, an injection water line, a gas line, and dual flow, concentric artificial lift fluid and test fluid lines. The connection for the oil production bar is also split into three parts carrying, respectively, a production oil line, a test fluid line and dual flow concentric chemical injection fluid and pump drive fluid lines.

Reverting to FIGS. 8A, B, and C, the umbilicals bringing power and signals to each control tray 20 of each three well process template are indicated at 43A, B, C, D and E and the jumper connections from the process templates 42 to the piping template 41 at 44A, B, C, D and E.

The piping template 41 has the necessary pipes and junctions to bring the oil production and the gas production from each individual template together and to lead them out through a series of connections 45 to sets of pipelines 46 and 47. The detail of this is shown in FIG. 10.

Figure 10:
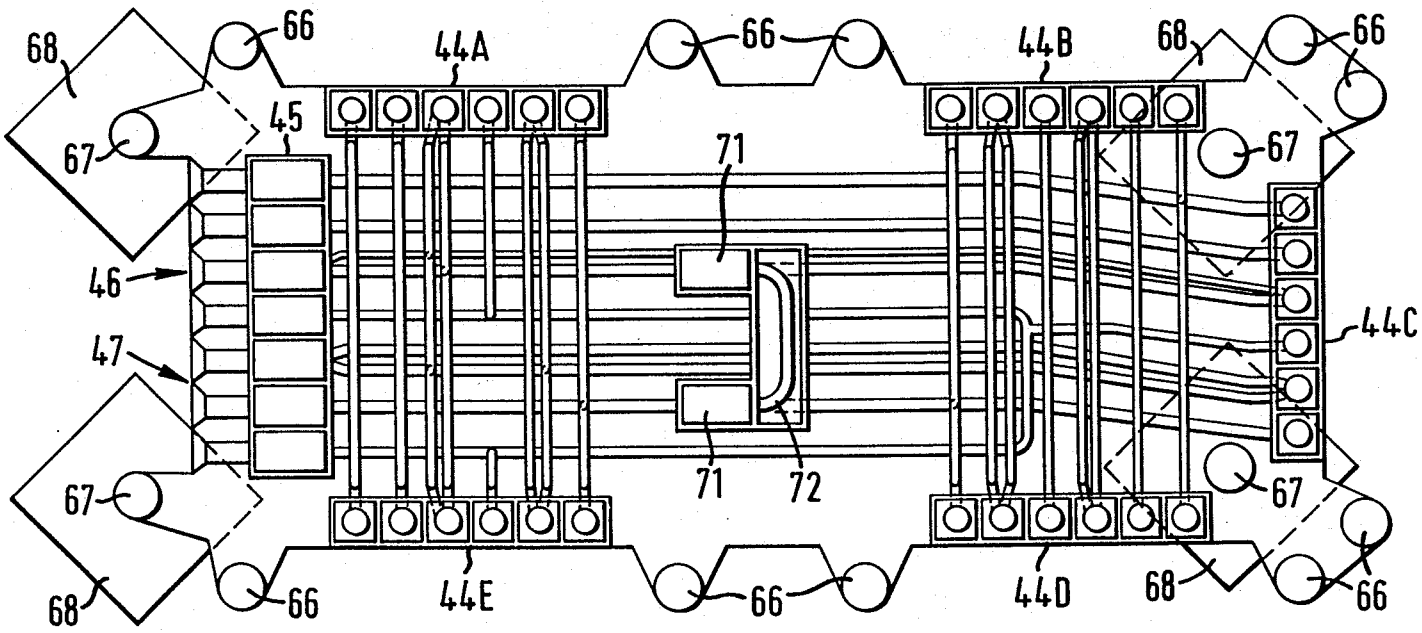
FIG. 10 is a plan of a piping template of the complex of FIG. 8.

FIG. 10 also shows that, since the gas and oil production piping bars have additional pipes for water injection, artifical lift fluid, chemical injection fluid and pump drive fluid, these pipes can also be brought over the jumper connections 44 and connected through connections 45 with pipes forming part of pipeline bundles 46 and 47 but dedicated to bringing the necessary fluids into the complex.

It will be seen from FIGS. 8A and 10 that, to cope with the oil production for five three well process templates (and possibly satellite wells also), the oil production pipework has been duplicated at the despatch side, two of the jumper connections 45 and two of the production flowline bundles 47 being dedicated to the despatch of the production oil.

The piping template 41 may have its own piles 66 which can also serve as docking piles for the three well process templates, screw levelling jacks 67 and mud mats 68 to ensure that it is held firmly and level on the sea bed. There may also be provision for pigging through pigging valves 71 and pigging loop 72.

We claim:

1. A sea bed oil producing and processing complex comprising (i) three rectangular bays housing pairs of modules, which are
  (a) a well bay housing a well module and a well choke module,
  (b) a gas production bay housing a gas production module and a second gas module, and
  (c) an oil production bay housing an oil production module and a pump module,
  said bays being positioned side-by-side, with the longer sides of the rectangles adjacent so that the well module, gas production module and oil production module are in a line at right angles to the length of the bays and well choke module, second gas module and pump module are similarly in line at right angles to the length of the bays,
(ii) a separator and pump for separating oil and gas and pumping separated oil,
(iii) a piping bar connecting the well choke module, second gas module and pump module, said bar being at right angles to the length of the bays, and
(iv) a gas piping bar parallel to the length of the gas production bay for the despatch of separated gas, and an oil piping bar parallel to the length of the oil production bay for the despatch of separated oil.

2. A sea bed complex as claimed in claim 1 wherein the well choke, gas production and oil production modules are each formed of a lower block and an upper block with an upper cap.

3. A sea bed complex as claimed in claim 1 wherein a saddle carries pipework across each of the pairs of well, gas production and oil production modules.

4. A sea bed complex as claimed in claim 1 having a control tray for feeding power and signals to the complex.

5. A sea bed complex as claimed in claim 1 wherein the separator is in the sea bed below the oil production pump module.

6. A sea bed complex as claimed in claim 1 having facilities for artificial lift, water injection, chemical fluid injection and for test fluid.

7. A sea bed complex as claimed in claim 6 wherein the artificial lift and water injection facilities are in the second gas module.

8. A sea bed complex as claimed in claim 1 wherein the complex has multiples of the three bays and pairs of modules.

9. A sea bed complex as claimed in claim 1 wherein a number of complexes are situated around a piping template.

* * * * *